US006560845B2

(12) United States Patent
Serafin et al.

(10) Patent No.: US 6,560,845 B2
(45) Date of Patent: May 13, 2003

(54) PREFINISHED DEFORMABLE METAL REFLECTOR SHEET

(75) Inventors: Daniel L. Serafin, Wexford, PA (US); Robert E. Bombalski, New Kensington, PA (US); Jean Ann Skiles, Gibsonia, PA (US); Albert L. Askin, Lower Burrell, PA (US); Sallie L. Blake, Long Grove, IA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/531,579

(22) Filed: Mar. 21, 2000

(65) Prior Publication Data

US 2002/0129484 A1 Sep. 19, 2002

Related U.S. Application Data

(60) Provisional application No. 60/137,985, filed on Jun. 7, 1999.

(51) Int. Cl.[7] ..... B21D 35/00

(52) U.S. Cl. ..... 29/469.5; 148/265; 148/256

(58) Field of Search ..... 29/469.5; 148/265, 148/256, 257

(56) References Cited

U.S. PATENT DOCUMENTS

| | | | | |
|---|---|---|---|---|
| 4,483,750 A | | 11/1984 | Powers et al. | 204/29 |
| 4,737,246 A | | 4/1988 | Powers et al. | 204/58 |
| 5,276,600 A | | 1/1994 | Takase et al. | 362/320 |
| 5,290,625 A | * | 3/1994 | Eisfeller et al. | |
| 5,384,161 A | * | 1/1995 | Eisfeller et al. | |
| 5,417,819 A | | 5/1995 | Askin et al. | 204/129 |
| 5,478,414 A | * | 12/1995 | Mozelewski et al. | |
| 5,637,404 A | | 6/1997 | Bombalski et al. | 428/422 |
| 5,672,409 A | * | 9/1997 | Miyakawa et al. | |
| 5,711,991 A | * | 1/1998 | Robinson et al. | |
| 5,725,683 A | | 3/1998 | Serafin et al. | 148/265 |
| 5,753,316 A | * | 5/1998 | Brent et al. | |
| 5,830,579 A | | 11/1998 | Benmalek et al. | 428/450 |
| 5,865,931 A | | 2/1999 | Serafin et al. | 156/269 |
| 5,955,147 A | * | 9/1999 | Serafin | |
| 5,985,046 A | | 11/1999 | Serafin et al. | 148/243 |
| 6,203,176 B1 | * | 3/2001 | Gordin | |

FOREIGN PATENT DOCUMENTS

| | | |
|---|---|---|
| JP | 2-269382 | * 11/1990 |

* cited by examiner

*Primary Examiner*—Douglas Olms
*Assistant Examiner*—Steven Blount
(74) *Attorney, Agent, or Firm*—Glenn E. Klepac

(57) ABSTRACT

A prefinished curved reflector suitable for use in recessed lighting, downlighting, head lamps, and tail lamps is made from metal sheet, preferably an aluminum alloy sheet. An outer surface of the metal sheet is either anodized, laminated, or polymer coated to provide desired appearance and performance. Surprisingly, the metal sheet retains its reflectivity and resistance to corrosion even after deformation into a curved reflector.

13 Claims, No Drawings

PREFINISHED DEFORMABLE METAL REFLECTOR SHEET

CROSS REFERENCE TO RELATED APPLICATION

This application claims the benefit of U.S. application Ser. No. 60/137,985 filed Jun. 7, 1999.

FIELD OF THE INVENTION

The present invention relates to sheet material for reflecting or decorative use, based upon metal substrates coated for protection against corrosion. Sheet material of the present invention is also capable of being worked into useful shapes, without detrimentally affecting its reflective ability or its anti-corrosion properties.

BACKGROUND OF THE INVENTION

Many types of lighting fixtures include a metal reflector behind a light source to beam the light in a desired direction and to improve lighting efficiency. Aluminum alloy sheet material is commonly used as such metal reflector because of its ability to maintain a high degree of brightness during use, its formability, and light weight. The brightness of aluminum alloy sheet can be dulled by corrosion in the surrounding atmosphere, by the deposition of fine dust, scratching, and even fingerprints.

In a conventional process for making shaped aluminum alloy reflectors, aluminum alloy sheet is subjected to bright rolling to improve its reflectivity. The bright rolled sheet is then shaped by bending, embossing, or other deformation processes to manufacture reflectors for recessed lighting, downlighting, head lamps, tail lamps, and other reflector applications. The shaped reflectors are typically buffed, chemically brightened, and anodized to improve their resistance to corrosion.

The prior art process described above is costly because anodizing the shaped reflector is an expensive, batch process. Accordingly, there still remains a need for a continuous process of making reflective metal sheet that is capable of being deformed into a desired configuration and maintains its reflective characteristics after it has been protected from corrosion.

A principal objective of the present invention is to provide a process for making reflective metal sheet material that is protected from corrosion, and also deformable without significantly diminishing its resistance to corrosion or its reflective characteristics.

A related objective of the invention is to provide an efficient and economical process for making shaped metal or laminated articles having excellent resistance to corrosion and reflective characteristics.

Additional objectives and advantages of our invention will become apparent to persons skilled in the art from the following detailed description.

SUMMARY OF THE INVENTION

In accordance with the present invention, there is provided a process for making a prefinished, deformable reflector sheet. The product is suitable for use in recessed and downlighting applications, in head lamps or tail lamps for motor vehicles, and other drawn or stamped reflector applications.

Metal sheet for making deformable reflector sheet in accordance with the present invention may be made from aluminum alloys or steel. Aluminum alloy sheet is particularly preferred. Suitable forms of steel include mild steel and stainless steel.

The aluminum alloy sheet comprises about 90 wt % or more aluminum together with one or more alloying elements. A particularly preferred alloying element is manganese, comprising about 0.5–1.5 wt % of Aluminum Association 3000 series alloys. Other suitable alloying elements include magnesium, comprising about 0.5–10 wt. % of AA 5000 series alloys; magnesium and silicon, each comprising about 0.5–10 wt % of AA 6000 series alloys; and zinc, comprising about 0.8–8 wt % of AA 7000 series alloys. Suitable tempers for alloys of the AA 5000, 6000, and 7000 series include the H1X, H2X, H3X, and 0 tempers (Aluminum Association designations).

Some particularly preferred AA 3000 series alloys include the AA 3002, 3003, and 3004 alloys, all containing about 1.0–1.5 wt. % manganese.

Some suitable AA 5000 series alloys containing about 0.5–5 wt % magnesium include the AA 5182, 5052, 5657, and 5252 alloys. A preferred AA 5657 alloy sheet has an 0 temper.

Aluminum alloys of the AA 1000 series, containing at least 99 wt. % aluminum, may also be used when excellent workability is desired.

DETAILED DESCRIPTION OF PREFERRED EMBODIMENTS

Several particularly preferred embodiments of our invention are described in the following examples.

EXAMPLE 1

CLEAR AND PIGMENTED COATING SYSTEMS

In a first embodiment of the invention, an aluminum alloy sheet is uncoiled and cleaned to remove surface contaminants from at least one outer surface. The sheet has a thickness of about 0.3–3 mm, preferably about 0.5–2.5 mm. A particularly preferred sheet has a thickness of about 1.3 mm (0.050 in). Next, the sheet is brightened, for example by treatment with a chemical brightener such as a hot mixture of phosphoric and nitric acids. The brightening treatment starts with 85% phosphoric acid and 70% nitric acid, in a 19:1 volumetric ratio. This ratio is reduced as aluminum phosphate accumulates in the brightening solution.

A conversion coating is next applied to the sheet in order to improve adhesion to a polymeric adhesive layer and for improved corrosion resistance. Both chrome-containing and chrome-free systems are suitable. The chrome conversion coating generally contains a chromate and a phosphate. Some known non-chrome conversion coatings are solutions containing zirconate, titanate, molybdate, tungstate, vanadate, and silicate ions, generally in combination with hydrogen fluoride or other fluoride compounds.

One suitable chrome-free conversion coating is the Betz Dearborn 1903 dry-in-place system. A suitable chrome-containing conversion coating is the Betz Dearborn 1904 dry-in-place system. These coatings are preferably applied via roll-coating to both sides of the sheet.

We prefer coating compositions containing about 20–50 wt % of the unsaturated polyester, possibly containing about 5–40 wt % pigment particles, and about 20–50 wt % organic solvent. The pigment particles may be titanium dioxide, alumina, silica, or mixtures thereof, and are preferably titanium dioxide. A particularly preferred coating composition made by PPG Industries, Inc. of Delaware, Ohio is sold under the trademark TRUFORM Coatings. A preferred coating thickness is about 0.50–1.5 mil (10–38 microns). The coating may be applied by dipping, spraying, or roll coating and is preferably applied by roll coating. In the case of a clear coating system, the aluminum alloy substrate may be chemically or electrochemically brightened prior to conversion coating to enhance surface reflectivity.

EXAMPLE 2

LAMINATES (METAL "IN")

In another embodiment, the aluminum alloy sheet is uncoiled and cleaned in an aqueous alkaline cleaning solution to remove organic surface contaminants from at least one outer surface. The sheet has a thickness of about 0.3–3 mm, preferably about 0.5–2.5 mm. A particularly preferred sheet has a thickness of about 1.3 mm (0.050 in).

A conversion coating is next applied to the sheet in order to improve adhesion to a polymeric adhesive layer and for improved corrosion resistance. Both chrome-containing and chrome-free systems are suitable. The chrome conversion coating generally contains a chromate and a phosphate. Some known non-chrome conversion coatings are solutions containing zirconate, titanate, molybdate, tungstate, vanadate, and silicate ions, generally in combination with hydrogen fluoride or other fluoride compounds.

One suitable chrome-free conversion coating is the Betz Dearborn 1903 dry-in-place system. A suitable chrome-containing conversion coating is the Betz Dearborn 1904 dry-in-place system. These coatings are preferably applied via roll-coating to both sides of the sheet.

A polymeric adhesive layer is applied to the front side of the cleaned and conversion coated sheet surface. The adhesive layer is preferably a polypropylene-containing adhesive such as Morton M805, and may be an epoxy-containing adhesive such as Morton 503A together with co-reactant F. The adhesive has a thickness of about 5–50 microns (0.2–2 mil). A particularly preferred adhesive layer has a thickness of about 10 microns (0.4 mil). Optionally, a thinner layer of an inexpensive coating may also be applied to the back side of the aluminum alloy sheet. The backside coating may be a PPG 1BHC5428 epoxy with a thickness of about 3–8 microns (0.1–0.3 mil).

The front side adhesive layer is joined to a polymer sheet that may have an interior side coated with a reflective metal layer. The polymer sheet is preferably a polyolefin such as polypropylene or a polypropylene-polyethylene copolymer, and may also be a polyester such as polyethylene terephthalate (PET) or polybutylene terephthalate (PBT), a polyimide, or polyvinyl chloride. If coated with a reflective metal layer, the polymer sheet must be resistant to outgassing when placed in a vacuum sputtering chamber. The polymer sheet may have a thickness of about 10–100 microns, and preferably about 10–30 microns. A particularly preferred polypropylene sheet has a thickness of about 1 mil (25 microns).

An interior side of the polyester sheet can be vacuum sputtered with a reflective metal layer having a thickness of about 1,000–10,000 Å. The metal layer may be silver, chromium, nickel, stainless steel, aluminum, or combinations thereof. A silver layer having a total thickness of about 5,000–10,000 Å is preferred.

EXAMPLE 3

LAMINATES (METAL "OUT")

In a third embodiment of the invention, an aluminum alloy sheet is uncoiled, cleaned, conversion coated, and coated with a layer of polymeric adhesive, all as described above.

The polymeric adhesive is joined to a polymeric carrier film having an interior side adjacent the carrier film and an exterior side coated with a reflective metal layer. The carrier film is preferably a polyolefin such as polypropylene or a polypropylene-polyethylene copolymer, and may also be a polyester such as polyethylene terephthalate or polybutylene terephthalate (PBT), a polyimide, or polyvinyl chloride. The carrier film must be resistant to outgassing when placed in a vacuum sputtering chamber. The carrier film may have a thickness of about 10–100 microns, preferably about 10–30 microns.

An exterior side of the carrier film is vacuum sputtered with a reflective metal layer having a thickness of less than about 10,000 Å. The metal layer may be chromium, nickel, stainless steel, aluminum, silver, or combinations thereof A stainless steel layer having a thickness of about 1,000 Å is preferred.

Optionally, the reflective metal layer is covered with a clear protective layer to improve scratch resistance. The protective layer is thinner than the metal layer and is preferably an oxide of silicon or titanium applied at a thickness of about 50–5000 Å. Optionally, the protective layer may be a transparent polymer. The protective layer is most preferably a layer of silicon dioxide sputtered in a vacuum chamber over the reflective metal layer.

EXAMPLE 4

ANODIZING

In a fourth embodiment, the aluminum alloy sheet is cleaned to remove surface contaminants from at least one outer surface. The sheet has a thickness of about 0.3–3 mm, preferably about 0.5–2.5 mm. A particularly preferred sheet has a thickness of about 1.3 mm (0.050 in).

Aluminum alloy sheet of the present invention may be as-rolled or bright rolled sheet. The sheet is uncoiled and then cleaned in a non-etching aqueous alkaline cleaning solution to remove surface contaminants.

Next, the sheet is brightened, for example by treatment with a chemical brightener such as a hot mixture of phosphoric and nitric acids. The brightening treatment starts with 85% phosphoric acid and 70% nitric acid, in a 19:1 volumetric ratio. This ratio is reduced as aluminum phosphate accumulates in the brightening solution.

The brightened aluminum alloy sheet is DC anodized to provide a protective layer of anodic aluminum oxide over the brightened surface. The anodizing bath contains an acid, preferably about 26–32 wt % sulfuric acid. The temperature of the bath is about 60–82° F. (16–28° C.), optimally about 74° F. Current density is at least about 18 amperes per square foot, preferably about 27–150 amperes per square foot.

The surface is anodized for a period of time sufficient to provide an anodic oxide thickness of about 0.06 to 0.22 mils (1.5–6 microns). The time required to produce this thickness will vary with current density, and is generally about 0.5–2 minutes. The coating thickness should not exceed about 0.22 mils in order to avoid attenuating the surface reflectance.

After anodizing, the sheet material is rinsed in deionized water. The anodized surface is preferably sealed in a nickel acetate solution and then dried. Other water-soluble nickel compounds may also be used for sealing the anodized surface.

Curved reflectors made in accordance with all 4 examples of our invention were subjected to the following performance tests.

Accelerated Exposure—ASTM G53 (QUV)

This test demonstrates the ability of a material to withstand degradation during exposure to cycles of UV light and water condensation.

Specimens are continuously cycled for 1000 hours through an 8 hour UV light exposure cycle at 140° F. followed by a four hour UV light-free condensation cycle at 120° F. and 100% humidity. Both scribed and non-scribed areas of the material are subjected to an ASTM D3359 tape pulling test. The objective of this test is to observe any surface deterioration of materials exposed to UV light, temperature cycles, and water condensation for extended time periods.

Humidity Accelerated Exposure—ASTM D2247

This test demonstrates the ability of a material to withstand degradation upon continuous exposure to a 100% humidity environment.

Specimens are continuously exposed to 100% humidity at 100° F. for 1,000 hours in a Cleveland Condensing Humidity Cabinet. Both scribed and non-scribed areas of the material are subjected to an ASTM D3559 tape pulling test. The specimens are observed for delamination and metal corrosion.

Salt Spray Exposure—ASTM B117

This test evaluates the ability of a material to withstand degradation upon continuous exposure to a corrosive environment. Specimens are continuously exposed to a 5% salt spray at 120° F. for 1,000 hours. Scribed areas on the metal reflector surface are periodically evaluated for metal corrosion.

Circular blanks having a diameter of 8.5 inches were cut from sheets of material made in accordance with all 4 examples described above. The blanks were hydroformed in a 15-ton hydroforming press to form cup-shaped reflectors having a 4 inch depth and a 4 inch inside diameter. Surprisingly, the reflectors made in accordance with all 4 examples survived the Accelerated Exposure, Humidity Accelerated Exposure, and Salt Spray Exposure tests.

Having described the presently preferred embodiments, it is to be understood that the invention may be otherwise embodied without departing from the spirit and scope of the following claims.

What is claimed is:

1. A process for making a curved reflector suitable for use in recessed lighting, downlighting head lamps, and tail lamps, comprising (a) providing a conversion coated metal sheet comprising steel or an aluminum alloy, (b) coating said metal sheet with a coating composition consisting essentially of a polymer selected from the group consisting of polyesters, polyolefins, and polyimides; particles of a filler selected from the group consisting of titanium dioxide, silica, calcium carbonate, and mixtures thereof; and an organic solvent, and (c) after steps (a) and (b), shaping the coated metal sheet into a curved reflector having a reflective concave inner side, said curved reflector being suitable for recessed lighting, downlighting, head lamps, and tail lamps.

2. The process of claim 1 further comprising (d) applying a layer of a polymeric primer to the conversion coated outer surface after step (a) and before step (b).

3. The process of claim 2 wherein said polymeric primer comprises a polypropylene resin.

4. The process of claim 1 wherein said metal sheet comprises an aluminum alloy selected from the group consisting of alloys of the AA1000, AA 3000, AA 5000, and AA 7000 series.

5. The process of claim 1 wherein said coating composition has a thickness of about 10–100 microns.

6. The process of claim 1 wherein said metal sheet has a thickness of about 0.5–2.5 mm.

7. The process of claim 1 wherein said curved reflector retains reflectivity after being shaped to a bend radius of less than about 20 mm.

8. The process of claim 1 wherein step (c) comprises shaping said metal sheet by at least one process selected from spin forming and hydroforming.

9. A process for making a curved reflector suitable for use in recessed lighting, downlighting, head lamps, and tail lamps, comprising a) conversion coating an outer surface of a metal sheet comprising steel or an aluminum alloy, b) coating the conversion coated metal sheet with a coating composition comprising a polymer, particles of a filler selected from the group consisting of titanium dioxide, silica, calcium carbonate, and mixtures thereof, and an organic solvent, and c) after steps (a) and (b), shaping the polymer coated metal sheet into a curved reflector having a reflective inner side, said curved reflector being suitable for recessed lighting, downlighting, head lamps, and tail lamps.

10. The process of claim 9, wherein said conversion coating comprises treating said outer surface of the metal sheet with a solution containing a chromate and a phosphate.

11. The process of claim 9, wherein said conversion coating comprises treating said outer surface of the metal sheet with a solution containing at least one of zirconate, titanate, molybate, vanadate, and silicate ions.

12. The process of claim 9, wherein said metal sheet has a thickness of about 3 mm, or less.

13. The process of claim 9, wherein said polymer in the coating composition is selected from the group consisting of polyesters, polyolefins, and polyimides.

* * * * *